US005788474A

United States Patent [19]

Chung et al.

[11] Patent Number: 5,788,474

[45] Date of Patent: Aug. 4, 1998

[54] SAFETY LIGHTER

[75] Inventors: Aman K. M. Chung, Hong Kong, Hong Kong; Richard G. Besha, Chevy Chase, Md.

[73] Assignee: Thai Merry Co. (America) Ltd., Hong Kong, Hong Kong

[21] Appl. No.: 708,585

[22] Filed: Sep. 5, 1996

[51] Int. Cl.[6] ..... F23D 11/36

[52] U.S. Cl. ..... 431/153; 431/277

[58] Field of Search ..... 431/153, 277

[56] References Cited

U.S. PATENT DOCUMENTS

| | | | |
|---|---|---|---|
| 4,830,603 | 5/1989 | Cirami . | |
| 5,002,482 | 3/1991 | Fairbanks et al. . | |
| 5,074,781 | 12/1991 | Fujita . | |
| 5,125,829 | 6/1992 | McDonough et al. . | |
| 5,184,948 | 2/1993 | Iwahori | 431/153 |
| 5,205,729 | 4/1993 | Iwahori | 431/153 |
| 5,215,458 | 6/1993 | Cirami . | |
| 5,242,297 | 9/1993 | Cirami | 431/153 |
| 5,417,563 | 5/1995 | Cirami . | |
| 5,427,522 | 6/1995 | McDonough et al. . | |
| 5,435,719 | 7/1995 | McDonough et al. . | |
| 5,445,518 | 8/1995 | McDonough et al. . | |
| 5,456,598 | 10/1995 | McDonough et al. . | |
| 5,472,338 | 12/1995 | Ansquer | 431/153 |
| 5,492,468 | 2/1996 | Cirami . | |

*Primary Examiner*—Carl D. Price
*Attorney, Agent, or Firm*—Nixon & Vanderhye

[57] ABSTRACT

The lighter includes a lever pivotal between lighter-unactuated and lighter-actuated positions. In the unactuated position, a locking member interferes with depression of the lever preventing actuation. The locking member is movable crosswise into a position unlocking the lighter for actuation and in which position the locking member is retained in the lighter-unlocked position by a catch. Upon depression of the thumb press of the lever to actuate the lighter, the locking member is released from its lighter-unlocked condition for return to a lighter-locked condition.

15 Claims, 3 Drawing Sheets

SAFETY LIGHTER

TECHNICAL FIELD

The present invention relates to a safety lighter for locking the lighter against lighter actuation and particularly to a safety lighter mechanism requiring movement of a safety latch or locking member in a single predetermined direction to enable the lighter for actuation.

BACKGROUND OF THE INVENTION

There has been recent and continuous emphasis in providing lighters which have a safety mechanism for preventing actuation of the lighter and which safety mechanism must be moved in a particular manner to enable the lighter for actuation. The principal purpose behind lighter designs of this type is to prevent children from being able to actuate the lighter. One of the more important features of lighters of this type is the capability of resetting the safety mechanism after a single actuation of the lighter actuator, e.g., a pivoted lever, such that the safety mechanism must again be displaced from a lighter-disabling position in order to actuate the lighter. Concurrently, with the need for safety mechanisms of this type, however, it is the desirability of permitting those other than children to be able to readily actuate the lighter without substantial difficulty or manipulation of the safety mechanism. It will be appreciated that these factors impose various constraints on the design of child safety lighters. Additionally, there is little available space on a conventional non-safety lighter for mounting a safety mechanism and typically it is desirable to provide a safety lighter having an appearance similar to a non-safety lighter but which requires movement of a safety mechanism in order to enable the lighter for actuation. Various designs for safety lighters have been proposed and constructed in the past, many of which are impractical or non-commercial for a variety of reasons, including manufacturing costs and the reliability of the components of the safety and lighter actuation mechanisms for repeated and continuous use.

SUMMARY OF THE INVENTION

According to the present invention, there is provided a novel and improved safety lighter having a safety mechanism which is movable in a single direction between a position disabling the lighter from lighter actuation and a position enabling the lighter for actuation. Particularly, the present invention provides a safety latch or locking member having a thumb piece which is movable in a single direction, preferably crosswise of the lighter at the thumb press end of the lighter-actuation lever to displace the locking member to a lighter-enabling position. The locking member includes an upwardly extending projection which, in a first lighter-disabling position, interferes with pivotal movement of the lighter actuation lever. Particularly, the locking member projection is engaged by a downwardly extending projection along the underside of the thumb press, preventing pivotal movement of the lever and lighter actuation. When the locking member is moved to a second lighter-enabling position, the interfering upwardly extending projection is moved out of the interfering position to a non-interfering position. Moreover, when the locking member is moved into the second position, a catch resiliently biased toward the locking member engages in a recess in the locking member to retain the locking member in the second position until the lighter is actuated. Upon actuation of the lever, a release element carried by the underside of the thumb press engages a release member resiliently biased toward the locking member and carrying the catch. Upon engagement, the lever cams the catch radially outwardly, releasing the locking member for return movement under the bias of a coil spring to the first position, disabling the lighter from actuation.

It will be appreciated in accordance with the foregoing that movement of the locking member solely in one direction, e.g., in a crosswise motion, enables the lighter for actuation. Upon actuation, the safety mechanism is automatically reset to the lighter-disabling position whereby the lighter cannot be actuated again until the safety mechanism is again moved by the user to a lighter-enabling position.

In a preferred embodiment according to the present invention, there is provided a flame producing lighter comprising a housing defining a reservoir for containing fuel, a valve for selective actuation between a normally closed position which prevents egress of fuel from the reservoir and an open position permitting egress of fuel from the reservoir through the valve, a spark producing element adjacent the valve for igniting the fuel when the valve is actuated to an open position, a lever pivotally carried by the housing having a thumb press at one end and engaging the valve at an opposite end for actuating the valve to the open position in response to displacing the thumb press in a direction toward the housing thereby pivoting the lever, a locking member carried by the housing and rotatable between a first position having a portion thereof underlying the thumb press to interfere with displacement of the thumb press in a direction toward the housing thereby preventing actuation of the lighter and a second position displacing the locking member portion into a non-interfering position with the thumb press to enable displacement of the thumb press in a direction toward the housing thereby enabling actuation of the lighter, a resilient element cooperable between the housing and the locking member for biasing the locking member for return to the first position, a releasable lock cooperable between the housing and the locking member for releasably retaining the locking member in the second position thereof and a release element carried by the lever and cooperable with the releasable lock to release the locking member from the second position for return to the first position under the bias of the resilient element.

In a further preferred embodiment according to the present invention, there is provided a flame producing lighter comprising a housing defining a reservoir for containing fuel, a valve for selective actuation between a normally closed position which prevents egress of fuel from the reservoir and an open position permitting egress of fuel from the reservoir through the valve, a spark producing element adjacent the valve for igniting the fuel when the valve is actuated to an open position, a lever pivotally carried by the housing having a thumb press at one end and engaging the valve at an opposite end for actuating the valve to the open position in response to displacing the thumb press in a direction toward the housing thereby pivoting the lever, a locking member carried by the housing and movable between a first position having a portion thereof underlying the thumb press to interfere with displacement of the thumb press in a direction toward the housing thereby preventing actuation of the lighter and a second position with the locking member portion displaced into a non-interfering position with the thumb press to enable displacement of the thumb press in a direction toward the housing thereby enabling actuation of the lighter, a resilient element cooperable between the housing and the locking member for biasing the locking member for return to the first position, a catch carried by the housing for releasably retaining the locking member in the second position thereof and a release element carried by the lever and cooperable with the catch to release the locking member from the second position for return to the first position under the bias of the resilient element.

Accordingly, it is a primary object of the present invention to provide a novel and improved safety lighter having a safety mechanism which is movable solely in a single direction from a lighter-disabling condition to a lighter-enabling condition which is automatically reset once removed from its lighter-disabling position such that the lighter is again locked against actuation after each actuation of the lighter.

DETAILED DESCRIPTION OF THE DRAWINGS

Figure 1:
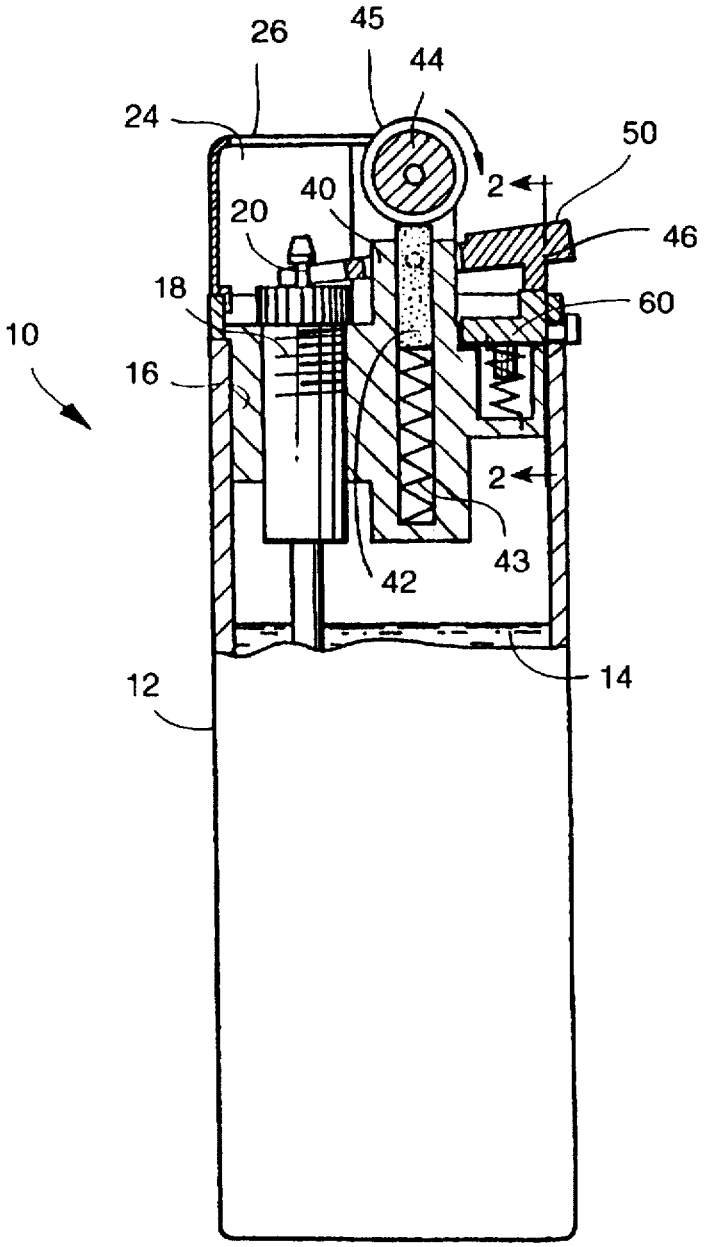
FIG. 1 is a side elevational view of a lighter constructed in accordance with the present invention and having portions broken out and in cross-section for illustrating various components of the lighter.
Figure 4:
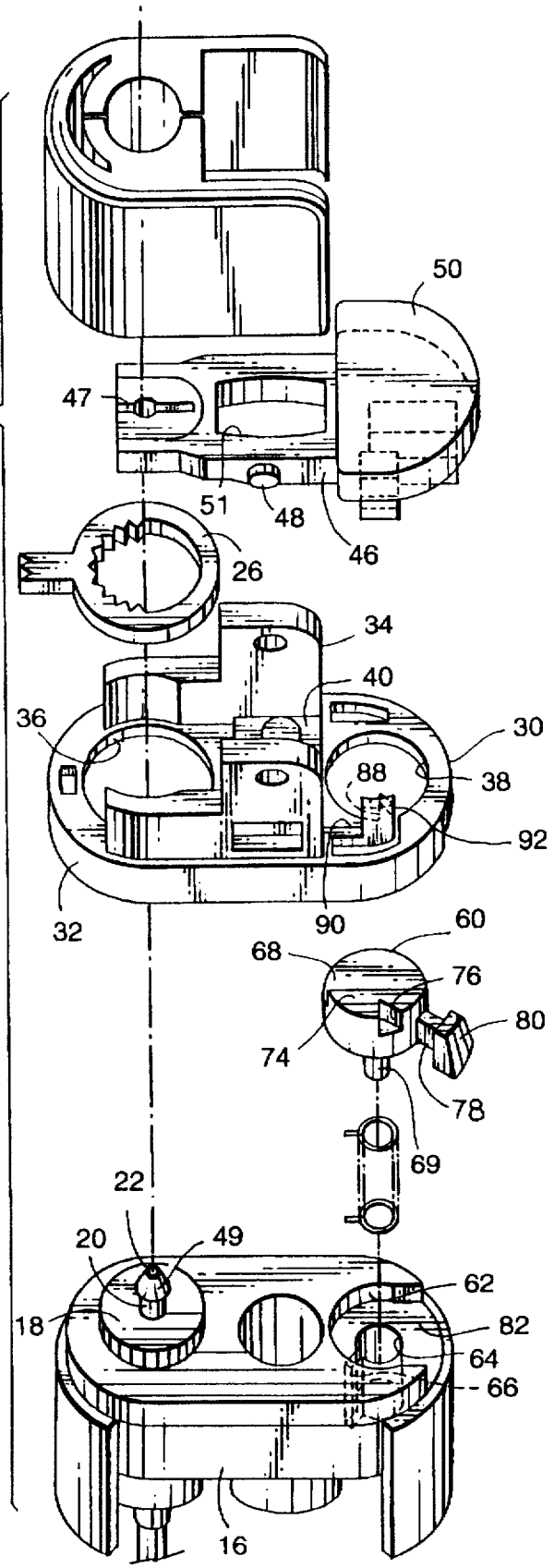
FIG. 4 is an exploded perspective view illustrating various parts of the lighter assembly, the spark wheel and a flint assembly being omitted for clarity.

Referring now to the drawings, particularly to FIG. 1, there is illustrated a lighter constructed in accordance with the present invention and generally designated 10. Lighter 10 includes a lighter housing 12 having a fuel compartment 14 for retaining fuel under pressure within lighter housing 12, and a valve housing 16 housing a valve screw 18 containing a spring biased valve stem 20, the lighter having a long axis, i.e., a vertical axis as the lighter is illustrated in FIG. 1. It will be appreciated that valve stem 20 is movable between a lower closed position illustrated in FIG. 1 and a raised open position relative to the valve screw 18 against the bias of a spring internal to the valve screw. The valve stem seats at its lower end in a stopper, not shown, and has an axially extending passageway 22 (FIG. 4). It will be appreciated that valve stem 20 normally seats in its lower position on the stopper closing the axial passageway 22 preventing fuel from escaping from the lighter housing 12 through the valve stem and is maintained in the valve closed position by the internal spring. When the valve stem is displaced upwardly, the lower end of the valve stem unseats from the stopper enabling fuel to flow through the axial passageway 22 and into a spark producing region 24 adjacent the upper end of the lighter 10. A valve adjusting ring 26 (FIG. 4) is provided about the valve screw 18 for adjusting the height of the flame once the gas is ignited in the region 24. The adjusting ring 26 and its operation vis-a-vis the valve is conventional. The spark region 24 is surrounded by a conventional windshield 26 mounted adjacent the upper hand of the lighter.

The lighter 10 also includes a middle case 30 having a depending marginal flange 32 which seats about a recessed portion of the valve housing 16. The middle case 30 mounts a pair of laterally spaced walls 34 upstanding in a central region of the middle case. At one end of the middle case, there is provided an opening 36 for accommodating the valve screw 18 as it projects upwardly through the middle case 30. The opposite end of middle case 30 includes an opening 38 for reasons discussed below.

Centrally within the middle case 30 is an upstanding rectilinear shaped sleeve 40 (FIG. 1) having a central aperture for receiving a spark producing element such as a flint 42. A coil spring 43 underlies the flint 42 within the rectilinear projection 40 for biasing the flint upwardly into engagement with a spark wheel 44. The central portion of the spark wheel 44 has a frictional surface for engaging the tip of the flint and a pair of larger wheels 45 having grooved outer surfaces straddle the central wheel 44 whereby the spark wheel can be rotated by a user to generate sparks in the flame region 24 by frictional contact between the spark wheel and flint 42. The spark wheels and flint are per se conventional in construction.

A lever 46 is pivotally carried between the walls 34 on pins or axles 48 engaging the walls for pivotal movement between an undepressed normal position as illustrated in FIG. 1 wherein the lighter is inactivated and a depressed position for raising the valve stem 20 to a lighter-actuated position. The lever 46 includes at one end a slot 47 for straddling on a reduced diameter portion of the valve stem 20 underlying the valve stem head 49. Thus, the internal spring of the valve stem maintains the lever 46 in a lighter-unactuated position. It will be appreciated that a spring underlying the opposite end of the lever may be employed to maintain the lever in the valve unactuated position. A central portion of lever 46 has a central opening 51 for receiving the projection 40 whereby the flint may be projected into underlying relation to the spark wheel 44. The lever 46 also includes a thumb press end 50. Thus, a user may rotate the spark wheel to generate sparks in region 24 and substantially simultaneously depress the thumb press end of the lever to pivot the lever about axles 48, hence raising the valve stem 20 and releasing fuel under pressure into spark region 24 whereby the lighter is actuated. The foregoing essentially describes known conventional elements of a lighter.

In order to releasably lock the lighter in a deactuated or disabled position, there is provided a locking member 60 which is received in the aperture 38 of middle case 30 and also in an aperture 62 formed in the valve housing 16. The aperture 62 has a coaxial cylindrical opening 64 closed at its lower end. Opening 64 includes a radial slot 66 in the valve housing 16. Locking member 60 comprises a central cylindrical section 68 received in aperture 62. Member 60 has a depending cylindrical projection 69 received in cylindrical opening 64. Also within the opening 64 is a resilient element, e.g., a helical spring 70, having one end received in the radial slot 66 and the opposite end received in a groove on or otherwise secured along the underside of the locking member 60. Locking member 60 also includes an upstanding projection 74, a notch or recess 76 along a side wall thereof and a laterally outwardly extending bridging portion 78 terminating in a finger press 80 accessible externally of the lighter housing. The middle case 30 has an end recess 82 opening along its lower edge which, together with the opening between the ends of aperture 62 of the valve housing 16, define a slot 82 for receiving the bridging portion 78 of locking member 60. The locking member 60 is mounted in the aperture 62 with the spring 70 biasing the locking member 60 for rotation toward one side of slot 82 where bridging portion 78 butts the edge of slot 82 and prevents further rotation. The projection 74 of locking member 60 in aperture 38 lies at an elevation generally corresponding to the upper horizontal surface of middle case 30.

Middle case 30 includes a releasable lock or catch 88 which projects radially inwardly of opening 38. Catch 88 is mounted on a resilient laterally flexible member 90 such that catch 88 is movable radially inwardly and outwardly between positions projecting radially within opening 38 and a position about the periphery of opening 38. Member 90 is, however, normally biased to project catch 88 radially inwardly into opening 38. Also mounted on resilient flexible member 90 is a release member 92 which projects upwardly above the surface of middle case 30 terminating in a surface 94 downwardly inclined toward aperture 38.

As illustrated in FIGS. 2A–2E, the thumb press end 50 of lever 46 has a projection 96 depending from its underside for engaging projection 74 of locking member 60 in the lighter-locked position as described below. The lower end of projection 96 has a tapered surface 95. Additionally, depending from the underside of thumb press 50 of lever 46 is a release element 98. Release element 98 terminates at its lower end in a tapered or downwardly inclined surface 100.

Figure 2E:
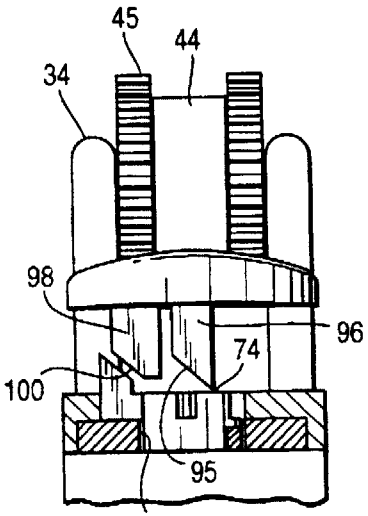
FIGS. 2A–2E are enlarged cross-sectional views taken generally about line 2—2 in FIG. 1 illustrating the sequence of operation of the lighter.
Figure 2D:
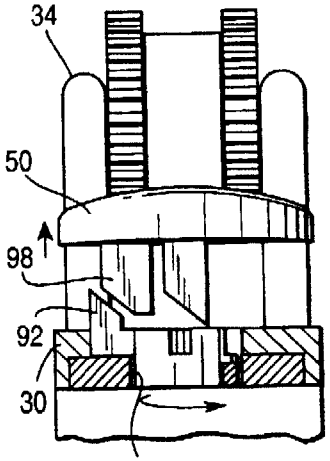
Figure 2C:
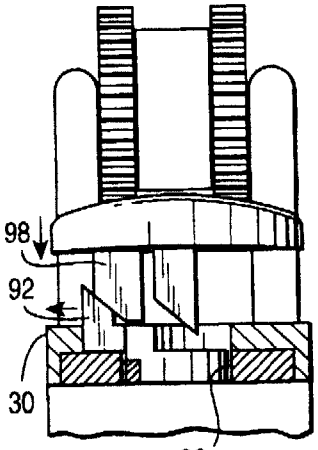
Figure 2B:
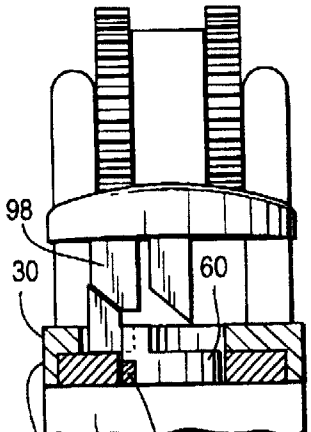
Figure 2A:
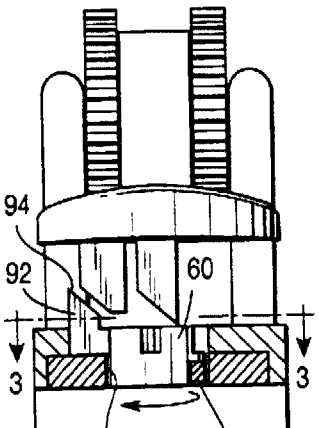
Figure 3D:
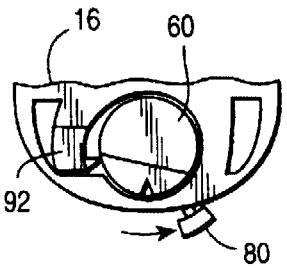
FIGS. 3A–3D are cross-sectional views taken generally about on line 3—3 in FIG. 2A illustrating the cooperation of the locking member and releasable lock, the views of FIGS. 3A–3D corresponding to FIGS. 2A–2D, respectively.
Figure 3C:
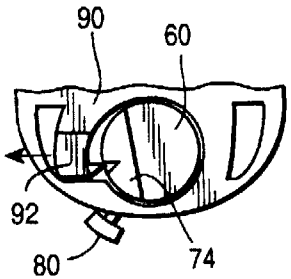
Figure 3B:
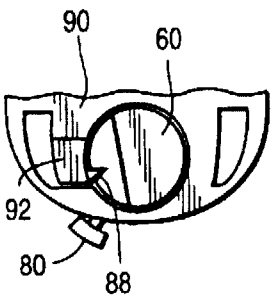
Figure 3A:
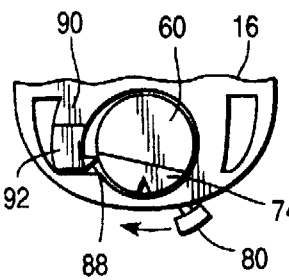

The operation of the lighter will now be explained. Referring to FIG. 2A, the locking member 60 is normally biased by spring 70 such that the bridging portion 78 and thumb press 80 lie adjacent an end of slot 82 with the locking member projection 74 underlying depending projection 96 of lever 46. As illustrated, the projection 96 prevents, i.e., interferes with, depression of thumb press 50 and hence pivotal movement of lever 46 by its engagement with projection 74 of locking member 60. As a consequence, actuation of the lighter is prevented. More particularly, the lever 46 cannot be pivoted in a direction which would raise the valve stem and permit fuel to escape through the axial passageway of the valve stem into the sparking region. It will also be appreciated that in this first position of the locking member 60, the resilient releasable lock or catch 88 bears against the side wall of projection 74 under the natural bias of member 90 tending to displace lock 88 radially inwardly into opening 38.

To actuate the lighter, the finger press 80 is displaced laterally or crosswise across slot 82 and against the bias of spring 70 to lie adjacent the opposite end of the slot. By rotating the locking member 60, the projection 74 rotates out of a position interfering with the depression of thumb 50 and pivoting of lever 46 and is thus displaced to a non-interfering position with projection 96 enabling thumb press 50 to be depressed hence pivoting lever 46 to open the valve to permit fuel flow into sparking region 24. When the locking member 60 is rotated to the lighter actuatable position, the notch 70 in projection 74 registers with the catch 88 and catch 88 is displaced radially inwardly under the bias of resilient member 90 to engage in the notch 76 retaining the locking member 60 against the bias of spring 70 in the lighter unlatched position. With the projection 74 of locking member 60 in a non-interfering position, thumb press 50 may be depressed pivoting the lever 46 to open the valve and enable lighter actuation by rotation of the sparking wheel to ignite the fuel released through the valve in the spark region.

To enable a single depression of the thumb press 50 to automatically return the lighter to a locked condition, release element 98 engages release member 92 upon depression of thumb press 50. Downward movement of element 98 cams member 92 and the flexible element 90 radially outwardly against the bias of member 90 to withdraw the releasable lock or catch 88 from the notch 70. When the catch 88 clears notch 76, spring 70 rotates locking member 60 to engage the projection 78 against the opposite end of the slot 82, thus returning locking member 60 to the lighter-locked position. It will be appreciated that release of the thumb press 50 by the user enables the valve spring to return the valve to its closed position as well as return the lever 46 to its normal position illustrated in FIG. 1. The return movement of projection 74 may also engage the tapered surface 95 of projection 94 to assist return of lever 46 to its normal position. With the automatic return of locking member 60 to the lighter-locked condition in response to depression of thumb press 50, the projection 74 is automatically returned to a position underlying projection 96. In that position, projection 96 once again interferes with the depression of thumb press 50 and pivoting of lever 46. With the return of the thumb press 50 into the lighter-locked condition, the release element 98 is also withdrawn upwardly from its engagement with the release member 92 and the catch 88 bears resiliently against the side wall of projection 74. In this manner, the releasable lock or catch 88 is permitted to engage notch 76 upon the next rotation of locking member 60 to a lighter-locked position.

It will be appreciated that with the foregoing described construction, the locking member 60 is movable in a single direction preferably in a lateral or crosswise direction between positions locking and unlocking the lighter. Also, when the locking member 60 is moved from the lighter-locked condition to the lighter-unlocked condition, the locking member 60 is retained in the lighter-unlocked condition until the thumb press 50 is depressed thus giving the user the option of waiting prior to lighter actuation. Once the thumb press 50 is depressed however the locking member 60 automatically returns to the lighter-locked condition precluding lighter actuation absent movement of the locking member 60 again to the lighter-unlocked condition.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A flame producing lighter comprising:

a housing defining a reservoir for containing fuel;

a valve for selective actuation between a normally closed position which prevents egress of fuel from said reservoir and an open position permitting egress of fuel from the reservoir through said valve;

a spark producing element adjacent said valve for igniting the fuel when the valve is actuated to an open position;

a lever pivotally carried by said housing having a thumb press at one end and engaging said valve at an opposite end for actuating said valve to said open position in response to displacing the thumb press in a direction toward said housing thereby pivoting said lever;

a locking member carried by said housing and rotatable between a first position having a portion thereof underlying said thumb press to interfere with displacement of the thumb press in a direction toward said housing thereby preventing actuation of the lighter and a second position displacing said locking member portion into a non-interfering position with said thumb press to enable displacement of the thumb press in a direction toward the housing thereby enabling actuation of the lighter;

said housing having a long axis, said locking member being rotatable about an axis generally parallel to said long axis between said first and second positions;

a resilient element cooperable between said housing and said locking member for biasing said locking member for return to said first position, and including a coil spring underlying said locking member and having an axis generally coincident with said axis of rotation of said locking member;

a releasable lock fixed to said housing and cooperable with said locking member for releasably retaining said locking member in said second position thereof; and a release element carried by said lever and cooperable with said releasable lock to release said locking member from said second position for return to said first position under the bias of said resilient element.

2. A lighter according to claim 1 wherein said locking member has a stop formed thereon, said releasable lock including a catch engaging said stop upon movement of said locking member into said second position and releasably retaining said locking member in said second position thereof.

3. A lighter according to claim 2 wherein said lever includes a cam and said catch includes a cam follower engageable by said cam and movable, in response to pivotal movement of said lever in a direction to actuate the lighter, in a direction to displace said catch from said stop enabling said locking member to return to said first position under the bias of said resilient element.

4. A lighter according to claim 2 wherein said locking member is movable solely in a single direction between said first and second positions.

5. A lighter according to claim 1 wherein said releasable lock upstands from said housing and is biased for displacement laterally toward said locking member.

6. A flame producing lighter comprising:

a housing defining a reservoir for containing fuel;

a valve for selective actuation between a normally closed position which prevents egress of fuel from said reservoir and an open position permitting egress of fuel from the reservoir through said valve;

a spark producing element adjacent said valve for igniting the fuel when the valve is actuated to an open position;

a lever pivotally carried by said housing having a thumb press at one end and engaging said valve at an opposite end for actuating said valve to said open position in response to displacing the thumb press in a direction toward said housing thereby pivoting said lever;

a locking member carried by said housing and rotatable between a first position having a portion thereof underlying said thumb press to interfere with displacement of the thumb press in a direction toward said housing thereby preventing actuation of the lighter and a second position displacing said locking member portion into a non-interfering position with said thumb press to enable displacement of the thumb press in a direction toward the housing thereby enabling actuation of the lighter;

said housing having a long axis, said locking member being pivotable about an axis generally parallel to said long axis and having a recess formed therein;

a resilient element cooperable between said housing and said locking member for biasing said locking member for return to said first position, and including a coil spring underlying said locking member and having an axis generally coincident with said axis of rotation of said locking member;

a releasable lock fixed to said housing and cooperable with said locking member for releasably retaining said locking member in said second position thereof; and a release element carried by said lever and cooperable with said releasable lock to release said locking member from said second position for return to said first position under the bias of said resilient element;

said releasable lock engaging in said recess and releasably retaining said locking member in said second position thereof.

7. A lighter according to claim 6 wherein said lever includes a cam and said releasable lock includes a cam follower engageable by said cam and movable, in response to pivotal movement of said lever in a direction to actuate the lighter, in a direction to displace said releasable lock from said recess, enabling said locking member to return to said first position under the bias of said resilient element.

8. A lighter according to claim 6 wherein said locking member is rotatable solely in a crosswise direction between said first and second positions.

9. A lighter according to claim 6 wherein said releasable lock upstands from said housing and is biased for displacement laterally toward said locking member.

10. A flame producing lighter comprising:

a housing defining a reservoir for containing fuel;

a valve for selective actuation between a normally closed position which prevents egress of fuel from said reservoir and an open position permitting egress of fuel from the reservoir through said valve;

a spark producing element adjacent said valve for igniting the fuel when the valve is actuated to an open position;

a lever pivotally carried by said housing having a thumb press at one end and engaging said valve at an opposite end for actuating said valve to said open position in response to displacing the thumb press in a direction toward said housing thereby pivoting said lever;

a locking member carried by said housing and rotatable between a first position having a portion thereof underlying said thumb press to interfere with displacement of the thumb press in a direction toward said housing thereby preventing actuation of the lighter and a second position displacing said locking member portion into a non-interfering position with said thumb press to enable displacement of the thumb press in a direction toward the housing thereby enabling actuation of the lighter;

said housing having a long axis, said locking member being rotatable about an axis generally parallel to said long axis between said first and second positions;

a resilient element cooperable between said housing and said locking member for biasing said locking member for return to said first position, and including a coil spring underlying said locking member and having an axis generally coincident with said axis of rotation of said locking member;

a releasable lock fixed to said housing and cooperable with said locking member for releasably retaining said locking member in said second position thereof; and a release element carried by said lever and cooperable with said releasable lock to release said locking member from said second position for return to said first position under the bias of said resilient element;

said releasable lock including a catch resiliently biased in a lateral direction generally toward the axis of rotation of said locking member, said locking member having a recess for receiving said catch, said release element being engageable with said lock in response to pivotal movement of said lever to a lighter actuation position to move said catch against the bias thereof to a position out of engagement in said recess enabling said locking member to return to said first position.

11. A lighter according to claim 10 wherein said lever includes a cam and said releasable lock includes a cam follower engageable by said cam and movable, in response to pivotal movement of said lever in a direction to actuate the lighter, in a direction to displace said releasable lock from engaging said recess.

12. A flame producing lighter comprising:

a housing defining a reservoir for containing fuel;

a valve for selective actuation between a normally closed position which prevents egress of fuel from said reservoir and an open position permitting egress of fuel from the reservoir through said valve;

a spark producing element adjacent said valve for igniting the fuel when the valve is actuated to an open position;

a lever pivotally carried by said housing having a thumb press at one end and engaging said valve at an opposite end for actuating said valve to said open position in response to displacing the thumb press in a direction toward said housing thereby pivoting said lever;

a locking member carried by said housing and movable between a first position having a portion thereof underlying said thumb press to interfere with displacement of the thumb press in a direction toward said housing thereby preventing actuation of the lighter and a second position with said locking member portion displaced into a non-interfering position with said thumb press to enable displacement of the thumb press in a direction toward the housing thereby enabling actuation of the lighter;

a resilient element cooperable between said housing and said locking member for biasing said locking member for return to said first position, and including a coil spring underlying said locking member and having an axis generally coincident with said axis of rotation of said locking member;

a catch fixedly carried by said housing for releasably retaining said locking member in said second position thereof; and a release element carried by said lever and cooperable with said catch to release said locking member from said second position for return to said first position under the bias of said resilient element;

said housing having a long axis, said locking member being movable in a single direction in a plane generally normal to said axis between said first and second positions, said catch being resiliently biased in a lateral direction generally toward said locking member, said locking member having a stop for engagement by said catch, said release element being engageable with said catch in response to movement of said lever to a lighter actuation position to move said catch against the bias thereof to a position out of engagement with said stop enabling said locking member to return to said first position.

13. A lighter according to claim 12 wherein said lever includes a cam and said catch includes a cam follower engageable by said cam and movable, in response to pivotal movement of said lever in a direction to actuate the lighter, in a direction to displace said catch from said stop.

14. A lighter according to claim 12 wherein said locking member includes a finger-actuatable portion for moving said locking member between said first and second positions, said catch being carried by a resilient member forming an integral portion of said housing and biased for movement toward said locking member, said resilient member carrying an upstanding release member having a tapered surface, said release element carrying a tapered surface generally complementary to said tapered surface of said resilient member and engageable therewith upon depression of said thumb press to cam said resilient member radially outwardly against said bias to move said catch to said out-of-engagement position with said stop.

15. A lighter according to claim 12 wherein said locking member has a recess, a wall of said recess forming said stop.

* * * * *